US009581003B2

(12) United States Patent
Kofoed et al.

(10) Patent No.: US 9,581,003 B2
(45) **Date of Patent: *Feb. 28, 2017**

(54) COMPLETING A WELL IN A RESERVOIR

(71) Applicants: Curtis W. Kofoed, Melba, ID (US); Pavlin B. Entchev, Moscow (RU); Stuart R. Keller, Houston, TX (US); Jeffrey D. Spitzenberger, Richmond, TX (US)

(72) Inventors: Curtis W. Kofoed, Melba, ID (US); Pavlin B. Entchev, Moscow (RU); Stuart R. Keller, Houston, TX (US); Jeffrey D. Spitzenberger, Richmond, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 253 days.

This patent is subject to a terminal disclaimer.

(21) Appl. No.: 14/347,217

(22) PCT Filed: Dec. 11, 2012

(86) PCT No.: PCT/US2012/069007

§ 371 (c)(1),
(2) Date: Mar. 25, 2014

(87) PCT Pub. No.: WO2013/090289

PCT Pub. Date: Jun. 20, 2013

(65) Prior Publication Data

US 2014/0318781 A1 Oct. 30, 2014

Related U.S. Application Data

(60) Provisional application No. 61/570,142, filed on Dec. 13, 2011.

(51) Int. Cl.
*E21B 33/12* (2006.01)
*E21B 43/25* (2006.01)
(Continued)

(52) U.S. Cl.
CPC ..... *E21B 43/25* (2013.01); *E21B 33/12* (2013.01); *E21B 33/124* (2013.01);
(Continued)

(58) Field of Classification Search
CPC .. E21B 33/124; E21B 2034/002; E21B 23/06; E21B 33/128; E21B 21/103
See application file for complete search history.

(56) References Cited

U.S. PATENT DOCUMENTS 2,847,074 A 8/1958 Maly et al.
3,358,770 A 12/1967 Zandmer
(Continued)

OTHER PUBLICATIONS

D. Baumgarten, et al., "Multi-Stage Acid Stimulation Improves Production Values in Carbonate Formations in Western Canada", SPE 126058, May 9-11, 2009, 2009 SPE Saudi Arabia Section Technical Symposium, pp. 1-11, Alkhobar Saudi Arabia.

*Primary Examiner* — Zakiya W Bates
(74) *Attorney, Agent, or Firm* — ExxonMobil Upstream Research Company-Law Department

(57) ABSTRACT

Methods and systems for completing a well including injecting stimulation fluid to stimulate a first interval in the reservoir. The stimulation fluid has a pressure sufficient to open a number of check valves in the first interval, allowing stimulation fluid to flow into the first interval. A number of ball sealers configured to block flow through the check valves are dropped into the well to stop the flow of stimulation fluid into the first interval and begin treatment of a second interval. The stimulation fluid is injected to stimulate a subsequent interval with pressure sufficient to open a number of check valves in the subsequent interval, allowing stimulation fluid to flow into the subsequent interval. The dropping of ball sealers is repeated until all intervals are treated. At least part of the check valves are configured to allow stimulation fluid to flow into a distribution chamber with multiple openings.

21 Claims, 13 Drawing Sheets

600

(51) Int. Cl.

| | |
|---|---|
| ***E21B 33/124*** | (2006.01) |
| ***E21B 33/138*** | (2006.01) |
| ***E21B 34/06*** | (2006.01) |
| ***E21B 43/14*** | (2006.01) |

(52) U.S. Cl.
CPC ..... *E21B 33/138* (2013.01); *E21B 34/06* (2013.01); *E21B 43/14* (2013.01)

(56) References Cited

U.S. PATENT DOCUMENTS

| | | | |
|---|---|---|---|
| 3,399,726 | A | 9/1968 | Harris et al. |
| 3,895,678 | A | 7/1975 | Wright et al. |
| 4,421,182 | A | 12/1983 | Moody et al. |
| 4,934,460 | A | 6/1990 | Coronado |
| 5,398,789 | A | 3/1995 | Handke |
| 5,942,469 | A | 8/1999 | Juprasert et al. |
| 6,394,184 | B2 | 5/2002 | Tolman et al. |
| 7,225,869 | B2 | 6/2007 | Willett et al. |
| 7,343,975 | B2 | 3/2008 | Surjaatmadja et al. |
| 7,748,460 | B2 | 7/2010 | Themig et al. |
| 7,819,199 | B2 | 10/2010 | Freyer |
| 2003/0188871 | A1 | 10/2003 | Dusterhoft et al. |
| 2005/0263284 | A1 | 12/2005 | Justus |
| 2006/0124310 | A1 | 6/2006 | Lopez de Cardenas et al. |
| 2008/0041588 | A1 | 2/2008 | Richards et al. |
| 2008/0179060 | A1 | 7/2008 | Surjaatmadja et al. |
| 2008/0314584 | A1 | 12/2008 | Cherewyk |
| 2009/0014168 | A1 | 1/2009 | Tips et al. |
| 2009/0151925 | A1 | 6/2009 | Richards et al. |
| 2009/0211769 | A1 | 8/2009 | Assal |
| 2009/0260815 | A1 | 10/2009 | Malone |
| 2010/0000727 | A1 | 1/2010 | Webb et al. |
| 2010/0044041 | A1 | 2/2010 | Smith et al. |
| 2011/0073313 | A1 | 3/2011 | Mathiesen et al. |
| 2011/0297393 | A1 | 12/2011 | Patel |

100

200

300

400

500

600

700

800

900

1000

1100

1200

1300

COMPLETING A WELL IN A RESERVOIR

CROSS REFERENCE TO RELATED APPLICATIONS

This application is the National Stage of International Application No. PCT/US2012/069007, filed Dec. 11, 2012, which claims the benefit of U.S. Provisional No. 61/570,142, filed Dec. 13, 2011, the entirety of which is incorporated herein by reference for all purposes.

FIELD

The present techniques relate to completions of horizontal wells. Specifically, techniques are disclosed for fluid stimulation in long horizontal wells.

BACKGROUND

This section is intended to introduce various aspects of the art, which may be associated with exemplary embodiments of the present techniques. This discussion is believed to assist in providing a framework to facilitate a better understanding of particular aspects of the present techniques. Accordingly, it should be understood that this section should be read in this light, and not necessarily as admissions of prior art.

Modern society is greatly dependent on the use of hydrocarbons for fuels and chemical feedstocks. Hydrocarbons are generally found in subsurface rock formations that can be termed "reservoirs." Removing hydrocarbons from the reservoirs depends on numerous physical properties of the rock formations, such as the permeability of the rock containing the hydrocarbons, the ability of the hydrocarbons to flow through the rock formations, and the proportion of hydrocarbons present, among others.

As many newer reservoirs are located in challenging environments, such as in deep oceanic environments, production methods increasingly rely on long (~300 m) and ultra-long (~3,000 m) open hole, horizontal well (OHHW) completions. These horizontal completions can be drilled from a single platform or rig to reach numerous locations in a reservoir. Long and ultra-long OHHW completions may present unique challenges associated with construction, completion, stimulation, or production. This may be due to a variety of factors, including the length of the well, variations in the subterranean formations that may be experienced along the length of the well, and variations in the reservoir fluids that may be encountered along the length of the well. Because of these and other factors, construction, completion, stimulation, or production operations may be improved by controlling a flow of fluid between the subterranean formation and the well.

To assist in flow control, wells are often completed with a variety of flow control devices and fluid flow conduits, including casing strings, production liner assemblies, packers, and uniformity enhancing devices, such as inflow control devices (ICDs). Casing strings and/or production liner assemblies may provide a conduit for the flow of fluid between the subterranean formation and a surface region. Packers may be placed within a well to inhibit fluid flow and isolate sections of the well. ICDs can provide a restriction to a flow of production fluids from the formation into the well, such as from the wellbore into the production liner. The restriction may be constant or may vary with a flow rate of the reservoir fluid through the ICD. As an illustrative example, a pressure drop across the ICD may increase significantly as a flow rate of reservoir fluid increases through the ICD. This has the effect of equalizing the inflow from different intervals. Further, the equalization helps to prevent the production of unwanted fluid such as water that might otherwise dominate the production. The ICDs can be adjusted to promote or hinder inflow from certain intervals.

After drilling, the production rates of the completed wells can be further improved by stimulation. Stimulation is a process by which the flow of hydrocarbons between a formation and a wellbore is improved. This can be performed by any number of techniques, such as fracturing a rock surrounding the wellbore with a high pressure fluid, injecting a surfactant into a reservoir, or injecting steam to lower the viscosity of the hydrocarbons. One technique uses an acid injection through the wellbore into the surrounding formation, which can remove drilling debris from the wellbore and increase flow from the formation, for example, by forming wormholes into the formation. Wormholes are small holes or cracks formed by acid attack on certain types of rock.

However, stimulating open hole, horizontal well (OHHW) completions, especially the distal portions, is very challenging due to the length of the completions. Acid placement is important for a successful acid stimulation. However, acid will generally flow into areas of least resistance, e.g., into areas of high permeability. This is opposed to the main objective of the matrix treatment, which is to increase the productivity of low permeability zones.

One approach to stimulation is to simply pump an acid through the ICDs. However, this approach only injects the acid in the vicinity of the ICDs and may fail to stimulate the formation away from the ICDs. Further, the ICDs restrict the rate of acid that can be injected. Even if the acid migrates along the annulus, recent research has indicated that it may be important for effective stimulation to achieve radial impingement of the acid on the formation achievable only by high injection rates. In addition, sizing the ICDs to work for both acid injection and hydrocarbon production can be problematic.

Another approach to stimulation is to pre-drill the liner with holes and then perform the stimulation using coiled tubing with an acid jetting Bottom Hole Assembly (BHA). By moving the coiled tubing during acidizing, essentially the entire production interval can be treated. However, this approach may not be feasible for longer wells, for example, greater than about 6,100 m (about 20,000 ft.) because of the difficulty in running coiled tubing in such wells. Also, coiled tubing typically limits acid pumping rates to <5 bbl/min where rates as great as 50 bbl/min may be desired for improved performance and reduced job time. Furthermore, pre-drilled holes preclude the use of ICDs, since the inflow would enter through the holes. Creating the perforations and renting the coiled tubing is also very expensive and may be difficult in remote locations.

Numerous mechanical and chemical diversion methods have been developed to place acid in the desired areas of the formation around the well. Mechanical methods make use of various bridge plugs, packers, ball sealers and their combination. Chemical diversion utilizes various chemical systems designed to make acid interact with the formation in the area of interest. Chemical systems used for diversion can include salt granules, waxes, foam, viscous pills, and the like.

For example, one approach to stimulating long horizontal wells is to use special ports that can be opened by dropping activation balls. The balls typically land in a sleeve that shears and opens ports in the liner. Then the acid can be pumped through the ports. This system is commonly used for multi-zone fracture stimulation of shale gas wells. However, the use of such a system would preclude the use of ICDs, since the hydrocarbons would enter the well through the open ports.

U.S. Pat. No. 7,748,460, to Themig, discloses a method and apparatus for wellbore fluid treatment. An apparatus includes a tubing string assembly for fluid treatment of a wellbore. The tubing string assembly includes substantially pressure holding closures spaced along the tubing string, which each close at least one port through the tubing string wall. The closures are openable by a sleeve drivable through the tubing string inner bore.

U.S. Patent Publication No. 2009/0151925 by Richards, et al., discloses a "well screen inflow control device with check valve flow controls." The well screen assembly includes a filter portion and a flow control device which varies a resistance to flow of fluid in response to a change in velocity of the fluid. Another well screen assembly includes a filter portion and a flow resistance device which decreases a resistance to flow of fluid in response to a predetermined stimulus applied from a remote location. Yet another well screen assembly includes a filter portion and a valve including an actuator having a piston which displaces in response to a pressure differential to thereby selectively permit and prevent flow of fluid through the valve.

The disclosures described above can target locations in a well for contact with a stimulation fluid. However, both describe complex methods and or assemblies that can be expensive to implement and may be difficult to install or use. Simpler techniques for targeted stimulation of certain zones are desirable.

SUMMARY

Embodiments described herein provide a method for completing a well in a reservoir. The method includes injecting a stimulation fluid to stimulate a first interval in the reservoir, wherein the stimulation fluid is at a pressure sufficient to open a number of check valves in the first interval, allowing stimulation fluid to flow into the first interval. The stimulation fluid from at least one check valve flows into the first interval through a plurality of openings in a distribution chamber. A number of ball sealers are dropped into the well to stop a flow of the stimulation fluid into the first interval and begin treatment of a second interval, wherein the ball sealers are configured to block flow through the check valves in the first interval. The stimulation fluid from at least one check valve flows into the second interval through a plurality of openings in a distribution chamber. The stimulation fluid is injected to stimulate a subsequent interval in the reservoir, wherein the stimulation fluid is at a pressure sufficient to open a number of check valves in the subsequent interval, allowing stimulation fluid to flow into the subsequent interval. The stimulation fluid from at least one check valve flows into the subsequent interval through a plurality of openings in a distribution chamber. The dropping of ball sealers is repeated until all intervals are treated.

Another embodiment provides a system for stimulation of a well. The system includes a wellbore drilled through an interval in a reservoir and a production liner installed in the wellbore, wherein the production liner comprises a number of check valves configured to allow flow from the production liner into the wellbore. At least a portion of the check valves are configured to allow flow into a distribution chamber and then into the wellbore. A seat behind each check valve in the production liner is configured to block the flow of fluid through the check valve when a ball sealer is in place on the seat. The system includes a number of packers placed in the well in the annulus between the wellbore and the production liner, wherein an interval is defined by the location of two sequential packers, and wherein at least two intervals are accessible from the wellbore through check valves. An injection system is configured to inject a plurality of inject ball sealers into the production liner as a pressure of a stimulation fluid in the production liner is increased.

Another embodiment provides a method for harvesting hydrocarbons from a well in a production interval. The method includes installing a production liner into a wellbore in a reservoir, wherein the production liner includes check valves that are configured to allow flow from the production liner into the wellbore and inflow control devices configured to allow a controlled fluid flow from the wellbore into the production liner. At least a portion of the check valves are configured to allow flow into a distribution chamber with multiple openings into the wellbore. A number of intervals along the wellbore are fluidically isolated by installing packers in the annulus between the wellbore and the production liner to isolate each interval from an adjacent interval, wherein at least two intervals are accessible from the production liner by check valves. A stimulation fluid is injected to stimulate a first interval in the reservoir. A set of ball sealers are dropped into the reservoir to stop acid flow into the first interval and begin treatment of a second interval. The dropping of ball sealers is repeated until all intervals are treated and the well is placed into production to harvest the hydrocarbons. The ball sealers are captured in a ball catcher as they flow to the surface.

DESCRIPTION OF THE DRAWINGS

The advantages of the present techniques are better understood by referring to the following detailed description and the attached drawings, in which:

FIG. 8 is a cross sectional view of a check valve in a mounting device that is incorporated into the wall of a pipe segment, such as a production liner, casing joint, and the like;

FIG. 9 is a cross sectional view of another mounting arrangement for a check valve on a wall of a pipe segment, such as a production liner, casing joint, and the like;

DETAILED DESCRIPTION

Figure 1:
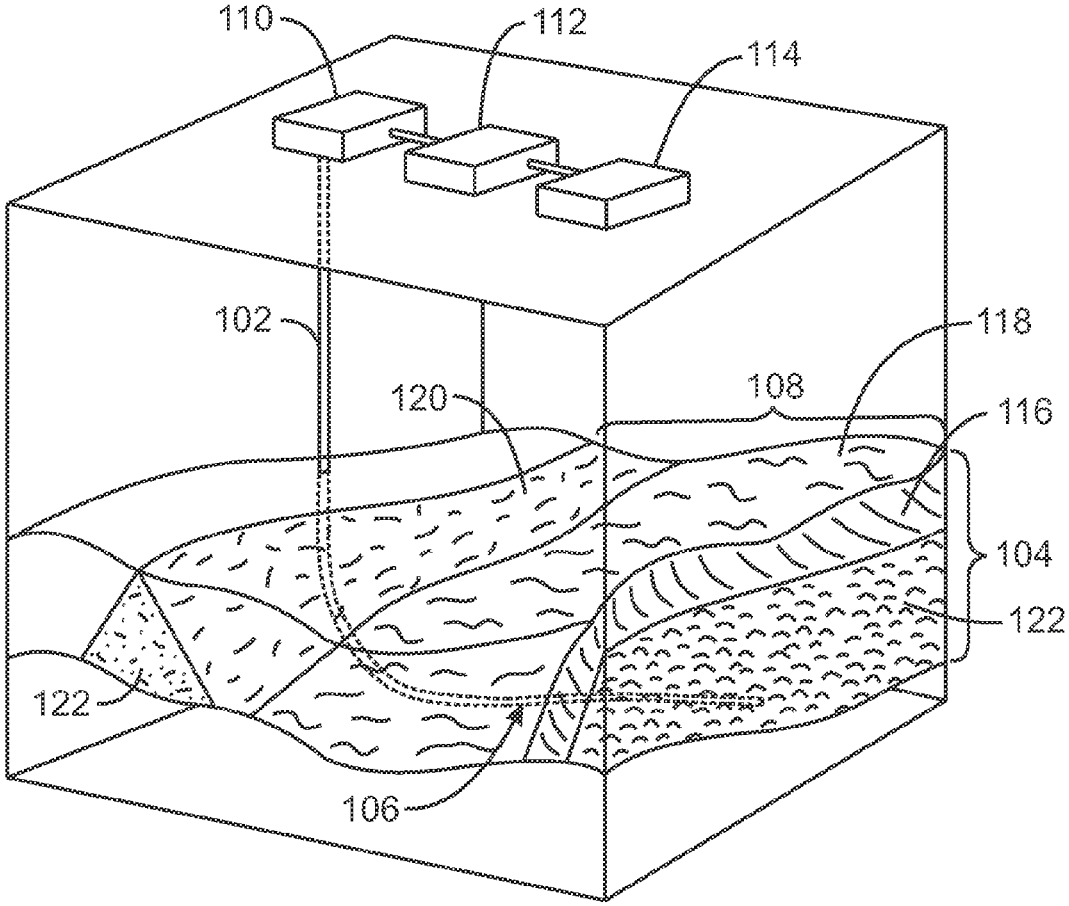
FIG. 1 is a drawing of a well drilled to reservoir, wherein the well has a significant horizontal section that extends through multiple rock types in the formation.

In the following detailed description section, specific embodiments of the present techniques are described. However, to the extent that the following description is specific to a particular embodiment or a particular use of the present techniques, this is intended to be for exemplary purposes only and simply provides a description of the exemplary embodiments. Accordingly, the techniques are not limited to the specific embodiments described below, but rather, include all alternatives, modifications, and equivalents falling within the true spirit and scope of the appended claims.

At the outset, for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

"Check valves" are devices used to allow flow in a single direction. For example, a check valve may have a ball that is held against a seal by a spring. When the pressure opposite the spring exceeds the sum of the pressure of the spring and the back pressure, on the side of the ball that the spring is located, the ball will move away from the seat, allowing flow around the ball. In the opposite direction, flow is blocked by both the force of the spring and the back pressure on the ball. Commercial check valves are available that could be used in embodiments described herein. For example, check valves are available from the Swagelok Corporation. In some embodiments, the check valves may be about ½" (about 1.3 cm) in diameter with a working pressure of 6000 psi (about 41,000 kPa) and selectable opening pressures of 1-25 psi (about 7 to about 172 kPa), depending on the spring tension, and an operating temperature of 300° F. (about 150° C.).

As used herein, two locations are in "fluid communication" when a path for fluid flow exists between the locations. For example, the drilling of a wellbore through a formation will place different locations along the wellbore in fluid communication with each other. As used herein, a fluid includes a gas or a liquid or mixture of gas and liquid and may include, for example, a produced hydrocarbon or an injected stimulation fluid, among other materials. Similarly, two locations can be "fluidically isolated" from each other to create zones along the wellbore by any number of techniques, including the placement of packers in an annulus between a production liner and a wellbore, the collapse of the formation around the wellbore, and other techniques.

"Facility" as used in this description is a tangible piece of physical equipment through which hydrocarbon fluids are either produced from a reservoir or injected into a reservoir, or equipment which can be used to control production or completion operations. In its broadest sense, the term facility is applied to any equipment that may be present along the flow path between a reservoir and its delivery outlets. Facilities may comprise production wells, injection wells, well tubulars, wellhead equipment, gathering lines, manifolds, pumps, compressors, separators, surface flow lines, steam generation plants, processing plants, and delivery outlets. In some instances, the term "surface facility" is used to distinguish those facilities other than wells.

The term "formation" refers to a body of rock or other subsurface solids that is sufficiently distinctive and continuous that it can be mapped. A formation can be a body of rock of predominantly one type or a combination of types. A formation can contain one or more hydrocarbon-bearing zones. Note that the terms "formation," "reservoir," and "interval" may be used interchangeably, but will generally be used to denote progressively smaller subsurface regions, volumes, or zones. More specifically, a "formation" will generally be the largest subsurface region, a "reservoir" will generally be a region within the "formation" and will generally be a hydrocarbon-bearing zone (a formation, reservoir, or interval having oil, gas, heavy oil, and any combination thereof), and an "interval" will generally refer to a sub-region or portion of a "reservoir." An interval, as used is herein, generally indicates a portion of a reservoir that is accessed by a well, such as a portion of a horizontal well, and is fluidically isolated from adjacent intervals by packers. As used herein, fluidically isolated merely refers to flow through the well or through an annulus along the well. It does not indicate that fluid flow through the rock of the interval itself is blocked.

A "hydrocarbon" is an organic compound that primarily includes the elements hydrogen and carbon, although nitrogen, sulfur, oxygen, metals, or any number of other elements may be present in small amounts. As used herein, hydrocarbons generally refer to components found in oil and natural gas.

As used herein, "packers" are a type of sealing mechanism used to block the flow of fluids through a well or an annulus within a well. Packers can include open hole packers, such as swelling elastomers, mechanical packers, or external casing packers, which can provide zonal segregation and isolation. Multiple sliding sleeves can also be used in conjunction with open hole packers to provide considerable flexibility in zonal flow control for the life of the wellbore. As used herein, the term "packers" also includes any other sealing mechanisms that can be used for zonal isolation and segregation, such as plugs, sliding plugs, ball sealing mechanisms, and any other sealing mechanism that can be used to isolate zones, such as a cement plug in an annulus, or a collapse of formation rock around a production liner.

"Permeability" is the capacity of a rock to transmit fluids through the interconnected pore spaces of the rock. Permeability may be measured using Darcy's Law: $Q=(k\Delta P\,A)/(\mu\,L)$, wherein Q=flow rate ($cm^3/s$), $\Delta P$=pressure drop (atm) across a cylinder having a length L (cm) and a cross-sectional area A ($cm^2$), $\mu$=fluid viscosity (cp), and k=permeability (Darcy).

"Porosity" is defined as the ratio of the volume of pore space to the total bulk volume of the material expressed in percent. Porosity is a measure of the reservoir rock's storage capacity for fluids. Porosity is preferably determined from cores, sonic logs, density logs, neutron logs or resistivity logs. Total or absolute porosity includes all the pore spaces, whereas effective porosity includes only the interconnected pores and corresponds to the pore volume available for depletion.

"Substantial" when used in reference to a quantity or amount of a material, or a specific characteristic thereof, refers to an amount that is sufficient to provide an effect that the material or characteristic was intended to provide. The exact degree of deviation allowable may depend on the specific context.

"Tubulars" include tubular goods and accessory equipment used to form and complete wells. Tubulars can include production liners, pipe joints, casing joints, production tubing, liner hangers, casing nipples, landing nipples and cross connects associated with completion of oil and gas wells.

A "wellbore" is a hole in the subsurface made by drilling or inserting a conduit into the subsurface. A wellbore may have a substantially circular cross section or any other cross-sectional shape, such as an oval, a square, a rectangle, a triangle, or other regular or irregular shapes. As used herein, the term "well", may refer to the entire hole from the surface to the toe or end in the formation, or may refer to a subsection, such as a substantially horizontal section located in an interval within a reservoir. The well is generally configured to convey fluids to and from a subsurface formation. Further, the term well may be used as a general term to describe any portion of the construction, from the surface to a horizontal production interval. The "well" often ends in a "production liner" which is a tubular that is configured to convey fluids to and from the adjacent portion of the wellbore. These terms are used for simplicity of explanation in the description provided herein. It will be clear to those of ordinary skill in the art that the techniques described herein may be used in any number of other completion configurations for wells.

As used herein, a "wormhole" is a high permeability channel that starts from a wellbore and propagating into an interval in a reservoir. In addition to forming naturally in some types of formation, wormholes can be generated during well stimulation processes by any number of techniques. For example, a corrosive fluid such as an acid may be used to generate wormholes in a carbonate formation. The development of wormholes may substantially enhance production in intervals within reservoirs.

Overview

Ultra long (300-3,000 m), open hole, horizontal completion intervals (OHHCI) have become increasingly common as they allow a larger contact zone with a reservoir combined with a favorable production index. Fluid stimulation of such wells, such as by acid, can greatly enhance their productivity and may remedy many flow impairment mechanisms caused early in the well's life due to drilling damage, or later in the well's life, due to scale, fines, condensate formation, non-Darcy effects, and the like. The acid can be delivered to the well using production tubing, drill pipe or coiled tubing.

However, intervals of such long lengths offer a unique challenge for acid placement. In particular, variations in formation pore pressure and/or permeability along the long intervals may cause the acid to preferentially flow into high permeability and/or low pressure zones and may furthermore create wormholes in these zones. Hence, acid injected at the later stages of stimulation tends to flow into the wormholes already created at the previous stages. This effect, termed "restimulation," leads to uneven growth of the wormholes in the formation. Accordingly, stimulation of specific sections of limited length may improve the results.

Embodiments described herein provide a method for improving recovery from a subsurface reservoir. More specifically, embodiments provide a method of high rate, efficient acid stimulation of ultra-long horizontal open hole wells, for example, for stimulating intervals ranging in length up to several thousand feet. A production liner that includes inflow control devices (ICDs), check valves, and ball sealers, allows for the sequential stimulation of different sections based on a change in pressure between an interior of the production liner and an exterior region in contact with a wellbore through a formation.

FIG. 1 is a drawing 100 of a well 102 drilled to reservoir 104, wherein the well 102 has a significant horizontal section 106 that extends through multiple rock types 108 in the formation. A well head 110 couples the well 102 to other apparatus that can be used for a stimulation operation, such as a pump 112 and a tank 114, for example, holding acid or other aggressive fluids for the stimulation. The multiple rock types 108 may include a number of different types formed by changes in the deposition environment. For example, a reservoir 104 may have mostly carbonate rock layers 116, 118, and 120, but may also have one or more cemented sand layers 122. As noted, the length of the horizontal section 106 of the well 102 may be long enough that significant restimulation occurs, leading to uneven growth of wormholes. Thus the horizontal section 106 may be divided into multiple zones that are individually stimulated, by blocking flow to zones during the stimulation of other zones. In some cases, higher permeability rock layers may not need stimulation.

Although acid is described as the stimulation fluid herein, other stimulation fluids may be used in embodiments, depending on rock solubility. For example, in some embodiments, water or a weak acid solution may be sufficient.

Figure 2:
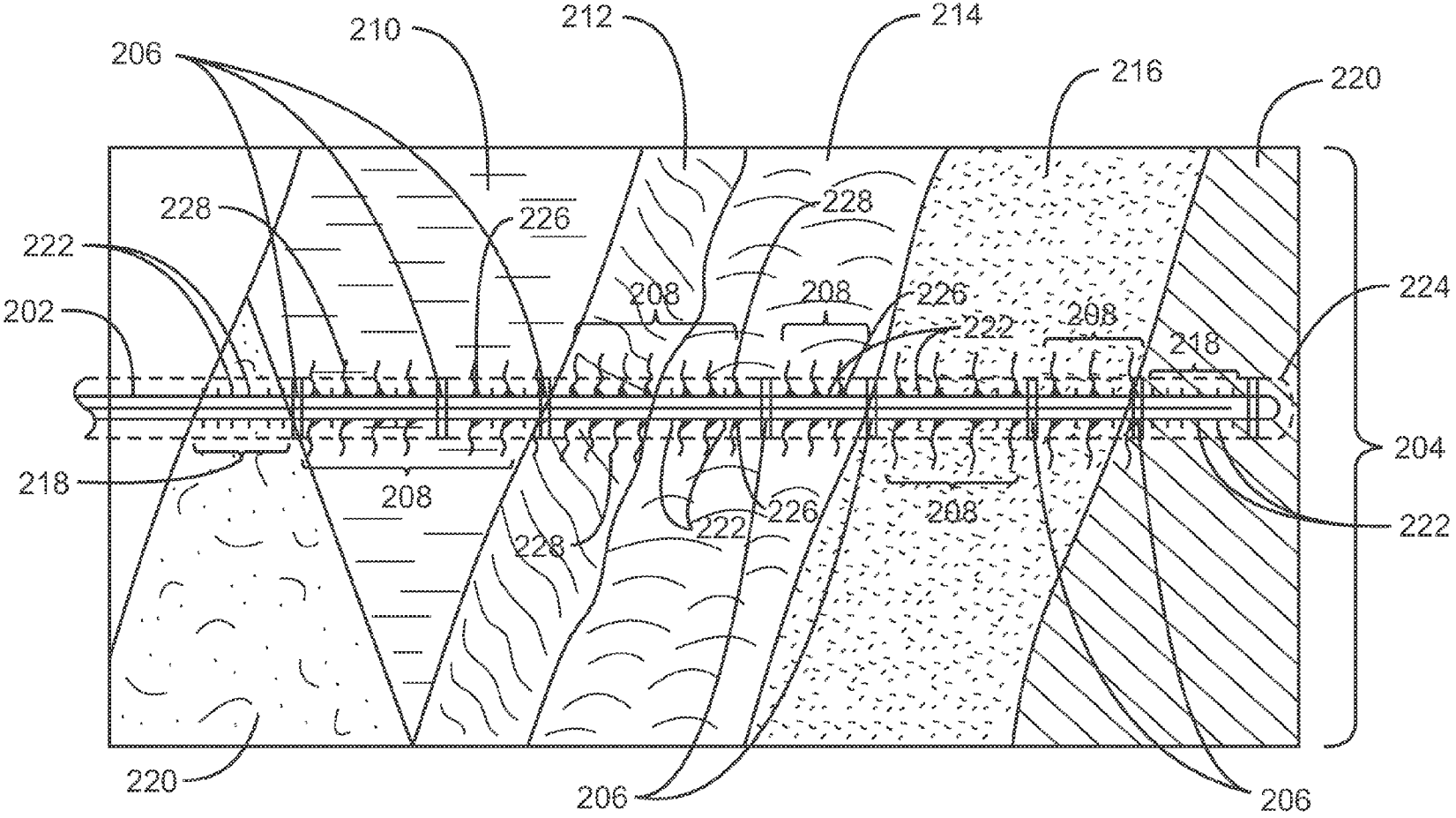
FIG. 2 is a drawing of a production liner through an interval that has multiple rock types.

FIG. 2 is a drawing 200 of a production liner 202 through an interval 204 that has multiple rock types. In the drawing 200, packers 206 have been placed to isolate zones, such as zones 208, for stimulation. Different zones 208 may have different pore pressures and permeabilities, for example, due to different rock types 210, 212, 214, and 216. Further, some zones 218 may not need stimulation, for example, when a high permeability rock type 220 is present in the interval 204.

In an embodiment, the production liner 202 has inflow control devices (ICDs) 222 to regulate the inflow of fluids from the various reservoir zones and the well bore 224 into the production liner 202. In zones 208 in which stimulation is desired, check valves can be installed, for example, into protrusions 226 from the production liner 202. The protrusions 226 can function as centralizers, locating the production liner 202 in the center of the wellbore 224, and may also protect the check valves from damage as the production liner 202 is inserted or rotated. As discussed with respect to the following figures, the check valves permit flow from the production liner 202 into the well bore and subsequently into the formation. Further, each of the check valves is mounted over a seat for a ball sealer, which can be used to block flow from that check valve.

As acid, or other stimulation fluids, are injected into the formation 204 from each check valve, they will attack debris in the well bore 224 and the wall of the well bore 224. The attack can create wormholes 228 that improve the flow of hydrocarbons from the formation 204, for example, by increasing the permeability of the rock types 210, 212, 214, and 216 of the formation 204.

Figure 3:
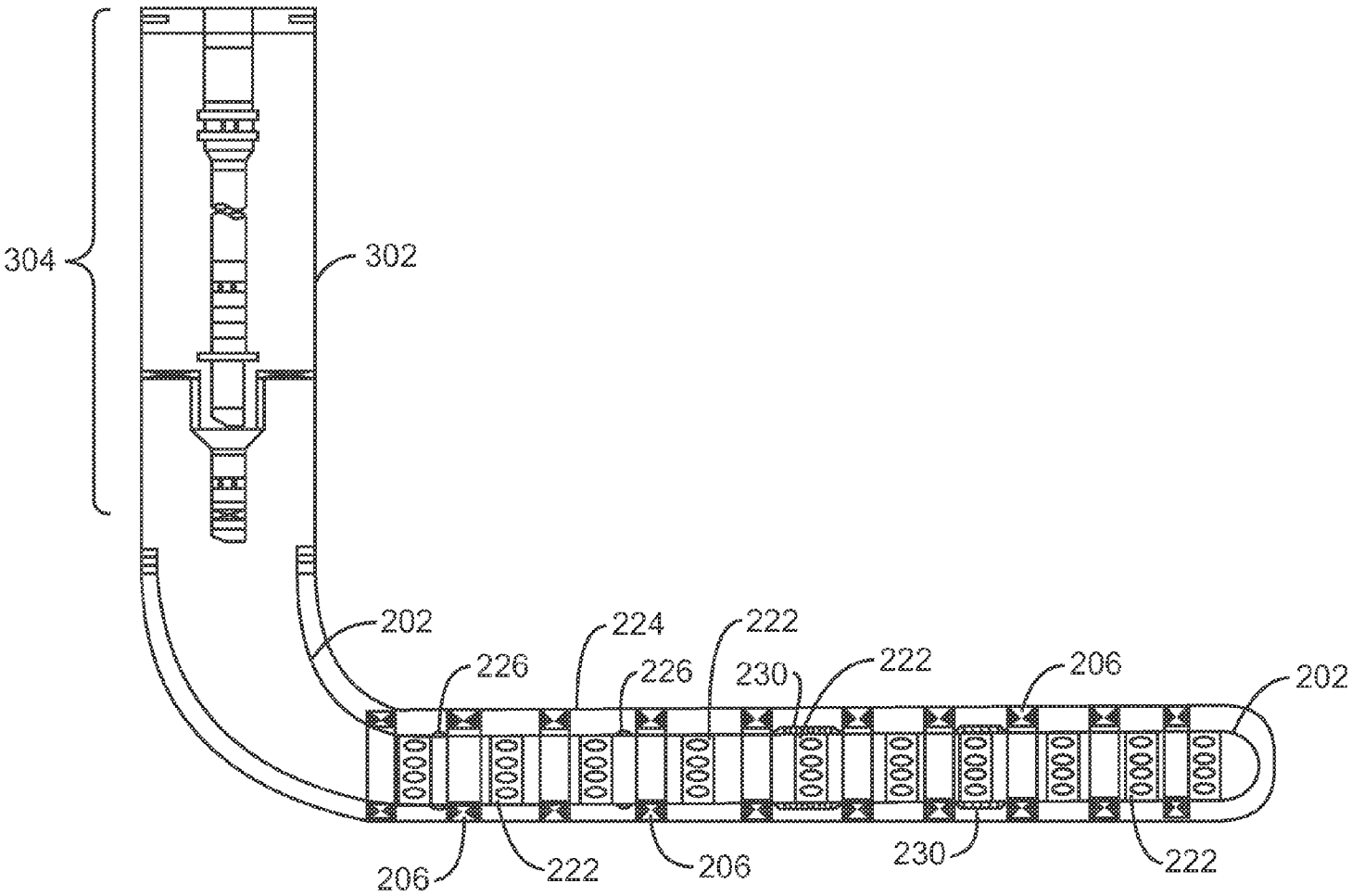
FIG. 3 is a cross sectional view of a production liner.

FIG. 3 is a cross sectional view 300 of a production liner 202. Like numbers are as discussed with respect to FIG. 2. The production liner 202 is suspended in a well bore 224 from a well casing 302. As will be clear to those of ordinary skill in the art, other equipment 304 can be used in the well casing 302 to facilitate production, including, for example, production tubing, sub-surface safety and control valves, down hole gauges, setting sleeves, and the like. Packers 206, placed along the outer surface of the production liner 202, may be made from a swellable material that expands in the presence of water or hydrocarbons. Accordingly, the packers 206 may be attached to the production liner 202 before placement, expanding after the production liner 202 is in place and isolating different zones. As noted, if the check valves are mounted in protrusions 226 along the outside of the production liner 202, the protrusions 226 may function as centralizers to center the production liner 202 in the wellbore 224. Further, normal centralizers may be used to center the production liner 202 instead of, or in addition to, the protrusions 226 holding the check valves. The check valves are not limited to being mounted in protrusions. In some embodiments, the check valves may open into distribution chambers 230 that have a number of different openings into the wellbore 224. As shown, the distribution chamber 230 is a long protrusion along the production liner 202, and may function as a centralizer or a stabilizer. The distribution chamber does not have to be a protrusion, but may be a recessed chamber incorporated into the wall of the production liner 202, as discussed with respect to FIG. 10.

Pressure Comparisons Between Wellbore and Production Liner

Figure 4:
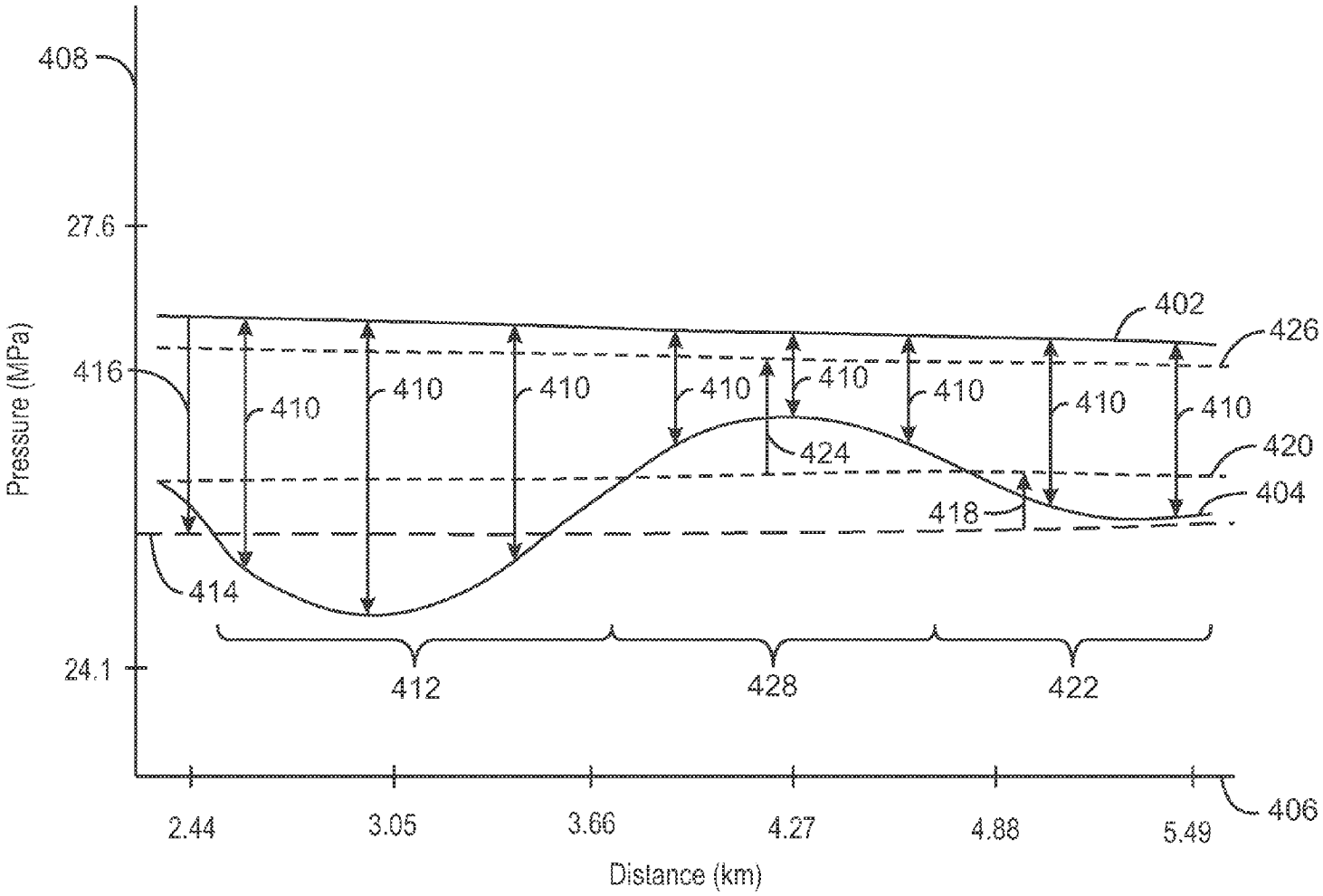
FIG. 4 is a plot showing a comparison of the pressure in a production liner with the pressure in the wellbore during a stimulation operation.

FIG. 4 is a plot 400 showing a comparison of the pressure in the production liner 402 with the pressure in the formation that is transmitted to the wellbore 404 during a stimulation operation. The x-axis 406 represents the distance of a horizontal interval in kilometers (km), while the y-axis 408 represents the pressure in megapascals (MPa). The check valves can be selected to open at particular pressure differentials 410 between the production liner pressure 402 and the reservoir controlled wellbore pressure 404. Thus, when a pressure differential 410 is reached, the check valves within that pressure differential will open and allow the fluid to enter the wellbore.

In the situation shown in the plot, the check valves in a first zone 412 reaching the greatest differential pressures 410 will open first. The opening of these check valves may cause the production liner pressure 402 to fall to the minimum pressure level 414 needed to keep those check valves open, as indicated by an arrow 416. In another embodiment, the production liner pressure 402 may be slowly increased to reach the minimum pressure level 414 or differential needed to open the check valves in the first zone 412.

However, under these conditions, if the pressure in the production liner was increased to open additional check valves in other zones, the check valves in the first zone 412 would stay open when other check valves are opened. Thus, the stimulation fluid would continue to flow into the first zone 412, causing overstimulation in the first zone 412, and causing less stimulation of other zones.

In an embodiment, ball sealer seats can be located in the production liner behind each of the check valves. When stimulation in a particular zone is finished, ball sealers are dropped into the well, and are carried by the fluid flow to the seats behind the check valves, blocking flow out of the open check valves. The pressure 402 in the production liner can then be increased, as indicated by arrow 418 to a level 420 that is sufficient to open a set of check valves in a second zone 422 having the next highest pressure differentials 410. Once stimulation is finished in the second zone 422, another set of ball sealers can be dropped into the well, which land on the seats of the check valves in the second zone 422, stopping flow through the check valves. The pressure can then be increased, as indicated by arrow 424 to a level 426 that is sufficient to open the check valves in a third zone 428. Once the stimulation is completed, the production liner pressure 402 can be allowed to fall low enough to start production, for example, through ICDs in the production liner. The ball sealers can then be flowed out and captured in a ball catcher. The sequence of events described above is shown in further detail in FIGS. 5-7.

It can be noted that the number of zones present, and the configuration of those zones, is not limited to that shown in FIG. 4, as any number of zones may be used. Further, the order in which the zones open is controlled by the pressure differentials 410 and may be in any order in the production liner.

Further, the pressure differentials 410 used to open the check valves can be selected to be at a single pressure value or at a number of different pressure values to control which valves open first. In the example illustrated in FIGS. 4-7, the check valves throughout the production liner 202 have been selected to have the same opening pressure, and, thus, an opening sequence that is controlled by the pressure in the formation 224 outside of the production liner 202.

Figure 5:
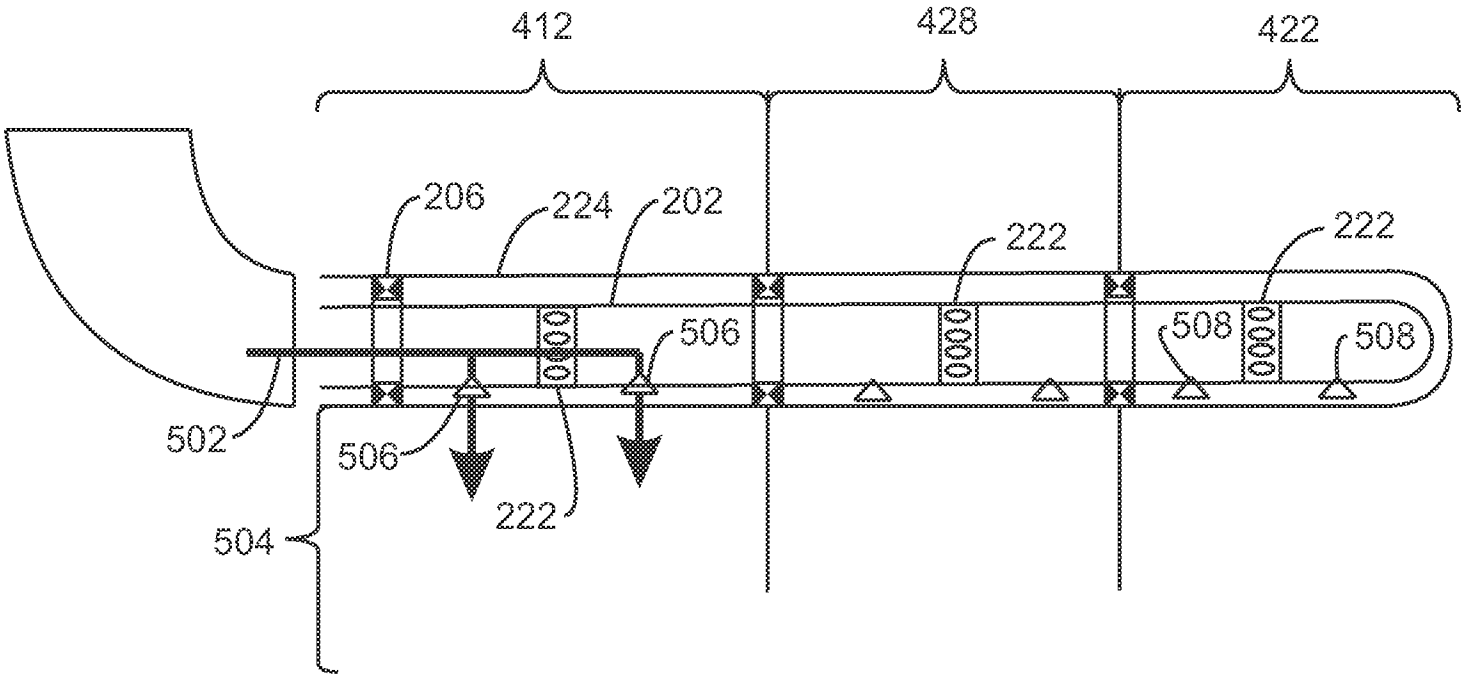
FIG. 5 is a cross sectional view of a wellbore and production liner showing the flow of a stimulation fluid into a formation through a first set of check valves.

FIG. 5 is a cross sectional view 500 of a wellbore 224 and production liner 202 showing the flow of a stimulation fluid 502 into a formation 504 through a first set of check valves 506. Like numbered items are as described in FIGS. 2 and 4, above. The check valves 506, as noted herein, permit flow from the production liner 202 into the wellbore 224. As the pressure differential is highest at the first zone 412, the check valves open first in this zone.

Production fluids can flow from the reservoir into the production liner 202 through the ICDs 222. However, to prevent flow of the stimulation fluid 502 into the wellbore 224 through the ICDs 222, the ICDs 222 may also be equipped with check valves. The flow of the stimulation fluid through the ICDs 222 may be limited in comparison to the flow through the check valves 506 and additional check valves may not be needed. As described above, a second set of check valves 508 may open at a higher pressure differential, for example, if the external pressure in the wellbore 224 exceeds a set point, or check valves that open at a higher pressure differential are selected.

Figure 6:
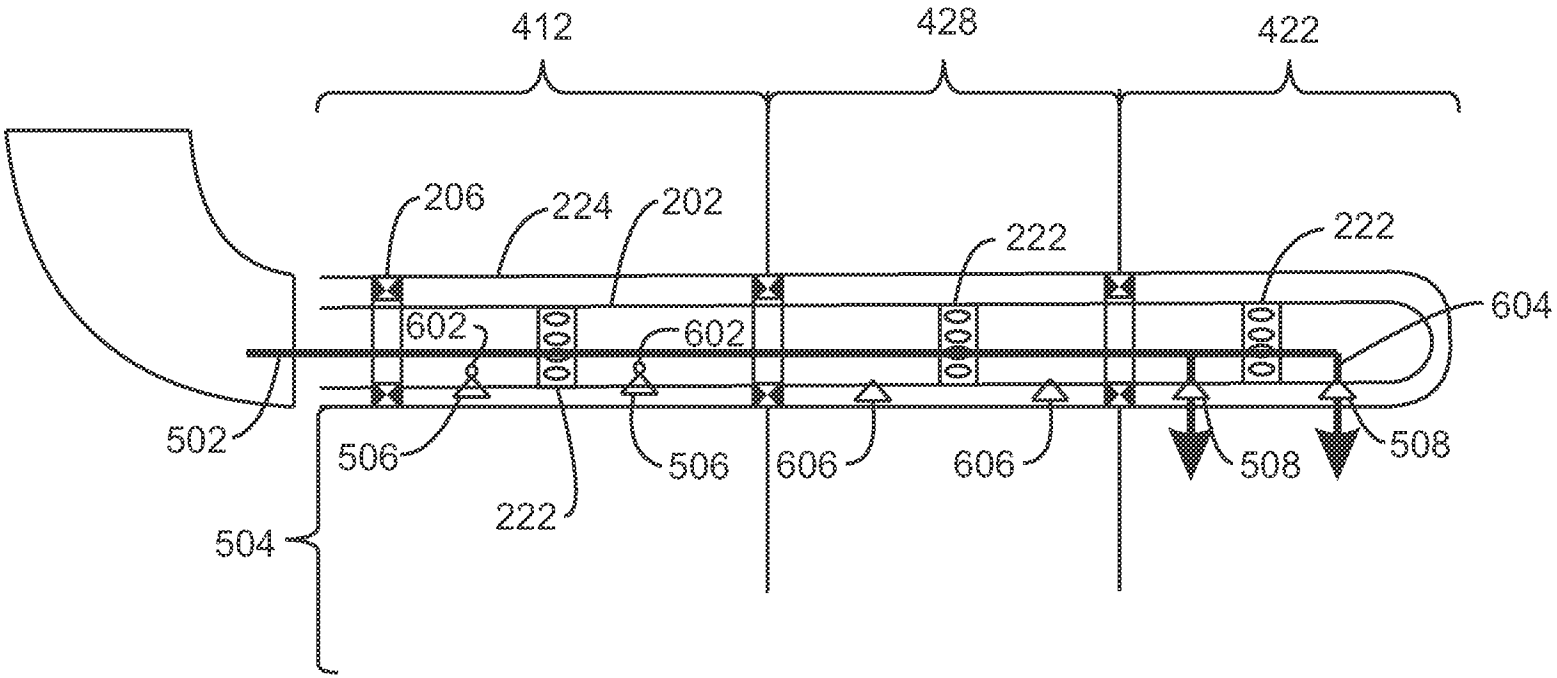
FIG. 6 is a drawing that shows the cross-sectional view of FIG. 5 after a first set of ball sealers have been dropped into the well.

FIG. 6 is a drawing 600 that shows the cross-sectional view of FIG. 5 after a first set of ball sealers 602 have been dropped into the well. The ball sealers 602 are carried to the check valves 506 in the first zone 412, and land on the seats in the production liner 202, blocking the flow out of the check valves 506. The pressure can then be increased in the production liner 202 until the pressure differential for the check valves 508 in the second zone 422 is exceeded, causing these check valves 508 to open, allowing flow 604 of the stimulation fluid through the check valves 508 and into the wellbore 224. However, the pressure differential is less than needed to open a third set of check valves 606 into the third zone 428.

Figure 7:
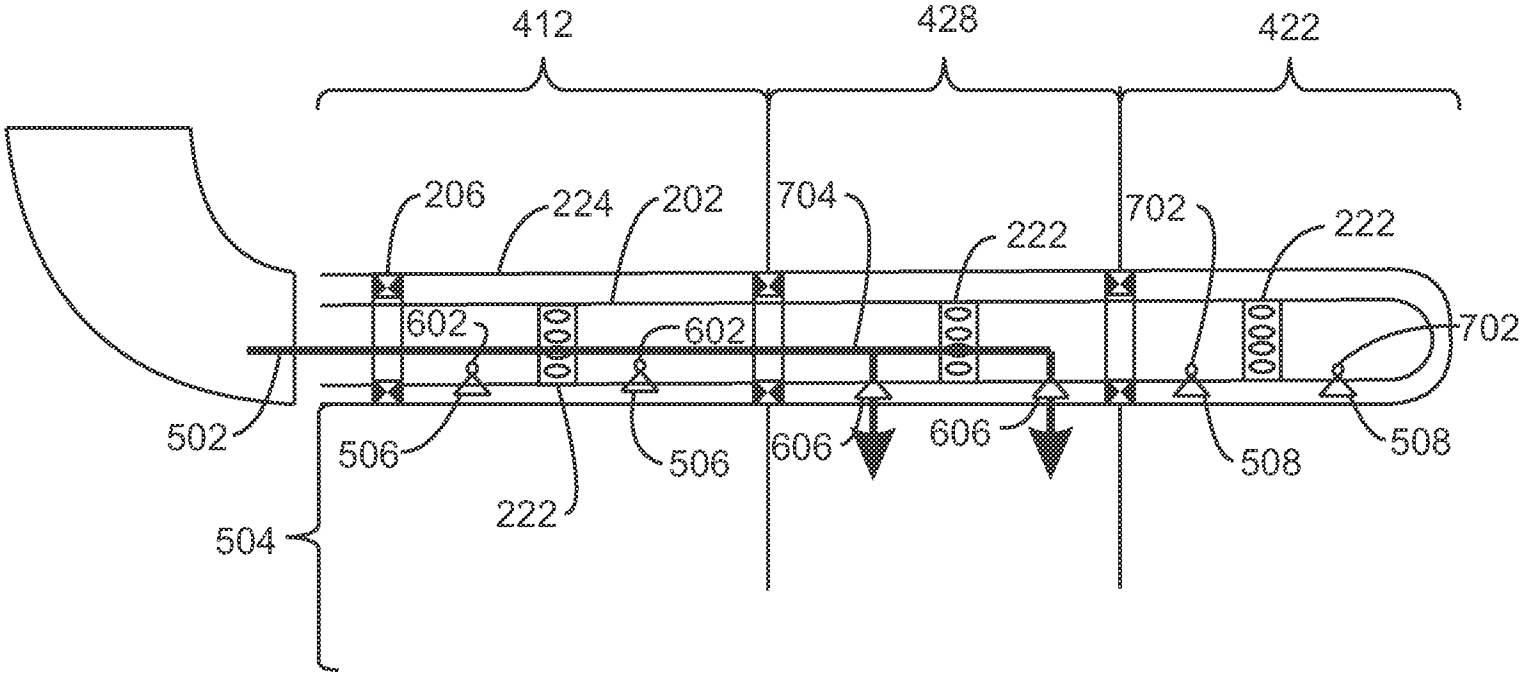
FIG. 7 is a drawing that shows the cross-sectional view of FIG. 6 after a second set of ball sealers have been dropped into the well.

FIG. 7 is a drawing 700 that shows the cross-sectional view of FIG. 6 after a second set of ball sealers 702 have been dropped into the well. The second set of ball sealers 702 block flow out of the check valves 508 in the second zone 422. The pressure in the production liner 202 can then be increased until the differential pressure is sufficient to open the check valves 606 in the third zone 428, allowing the stimulation fluid 704 to flow into the wellbore 224 in the third zone. Once the stimulation of the third zone 428, and any subsequent zones, is completed, the pressure in the production liner 202 can be lowered to allow production fluids to flow into the production liner 202 through the ICDs 222. The ball sealers 602 and 702 will be flowed back to the surface and can be captured in a ball catcher. The ball sealers 602 and 702 may be standard types of ball sealers used in the industry. Further, the density of the ball sealers 602 and 702 can be selected to match the density of the stimulation fluid, making them neutrally buoyant. This can help to prevent the ball sealers from settling out of the solution, or floating away, before they reach a target seat.

Incorporating Check Valves and Seats into a Production Liner

Figure 8:
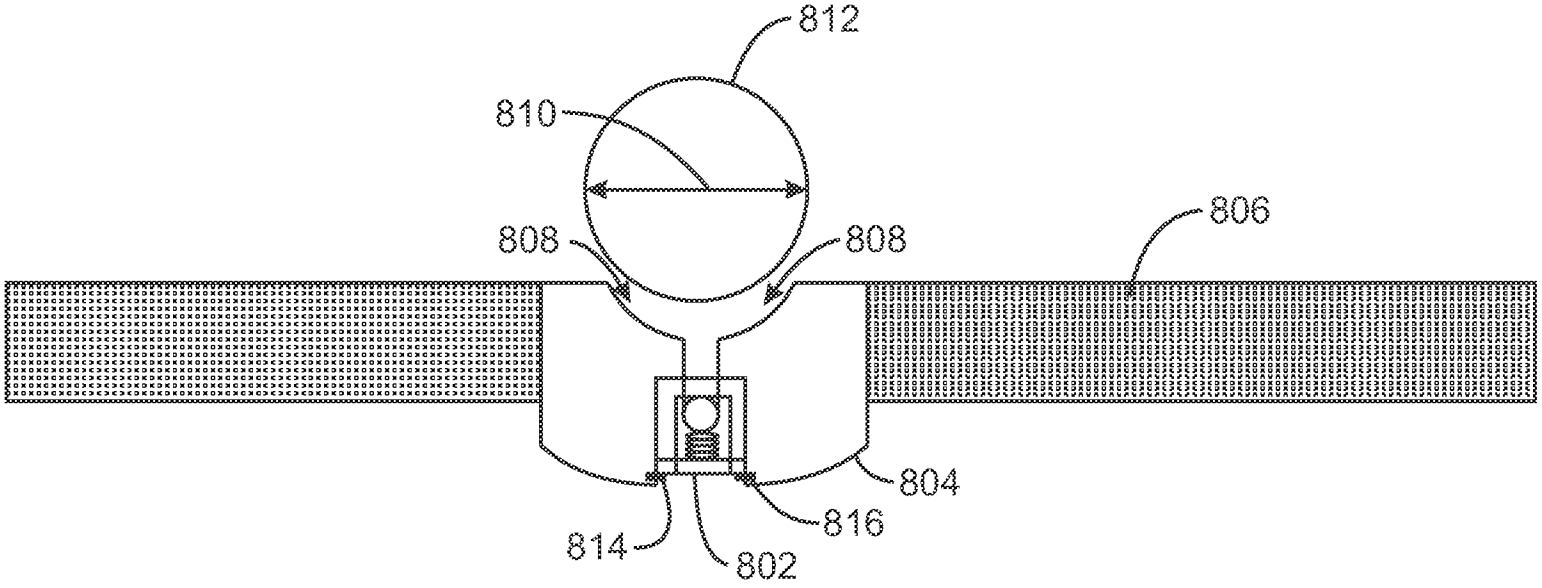

FIG. 8 is a cross sectional view 800 of a check valve 802 in a mounting device 804 that is incorporated into the wall 806 of a pipe segment, such as a production liner, casing joint, pipe joint, and the like. The check valve can be held in place in the mounting device 804 by a snap ring 814 that fits into a notch 816 in the mounting device 804. As shown in the cross sectional view 800, the mounting device 804 can be modified to have a seat profile 808 that matches the diameter 810 of the ball sealer 812. This can improve the seating of the ball sealer 812 during the pumping operation. However, the seat profile 808 does not have to match the ball sealer 812, as other arrangements may work.

Figure 9:
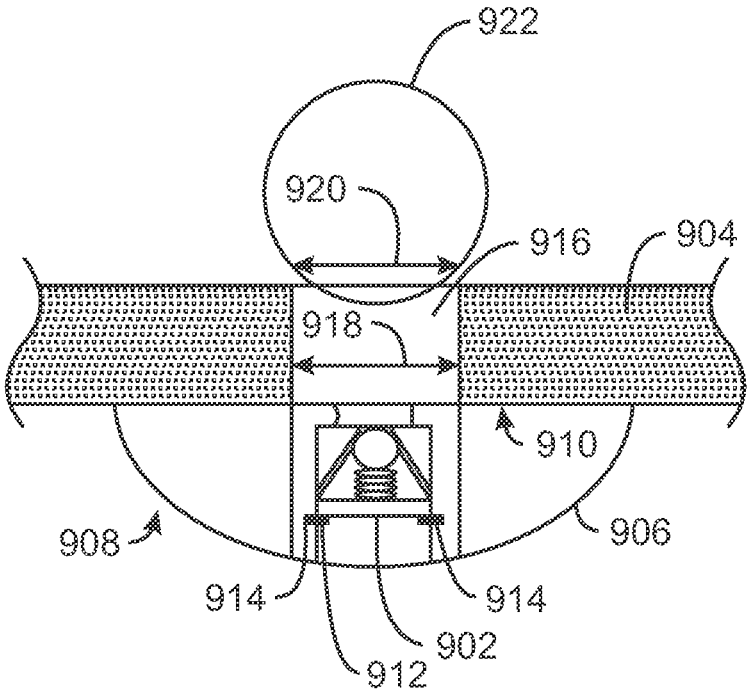

FIG. 9 is a cross sectional view 900 of another mounting arrangement for a check valve 902 on a wall 904 of a pipe segment, such as a production liner, casing joint, and the like. In this embodiment, the check valve 902 is incorporated into a protrusion 906 that has a curved top surface 908 to slide through a wellbore. The bottom surface 910 of the protrusion 906 is configured to fit flush against the wall 904, and is welded to the wall 904 to form a permanent construct. The check valve 902 can be held in the protrusion by a snap ring 912 that fits into a notch 914 in the protrusion 906.

The opening through the wall 904 of the pipe segment may simply be a hole 916 drilled through the wall 904, for example, prior to the mounting of protrusion 906. The diameter 918 of the hole can be selected to match an appropriate portion 920 of a ball sealer 922 to help in holding it in place. In some embodiments, the opening is profiled to match the diameter of the ball sealer 922, as described with respect to FIG. 8.

Figure 10:
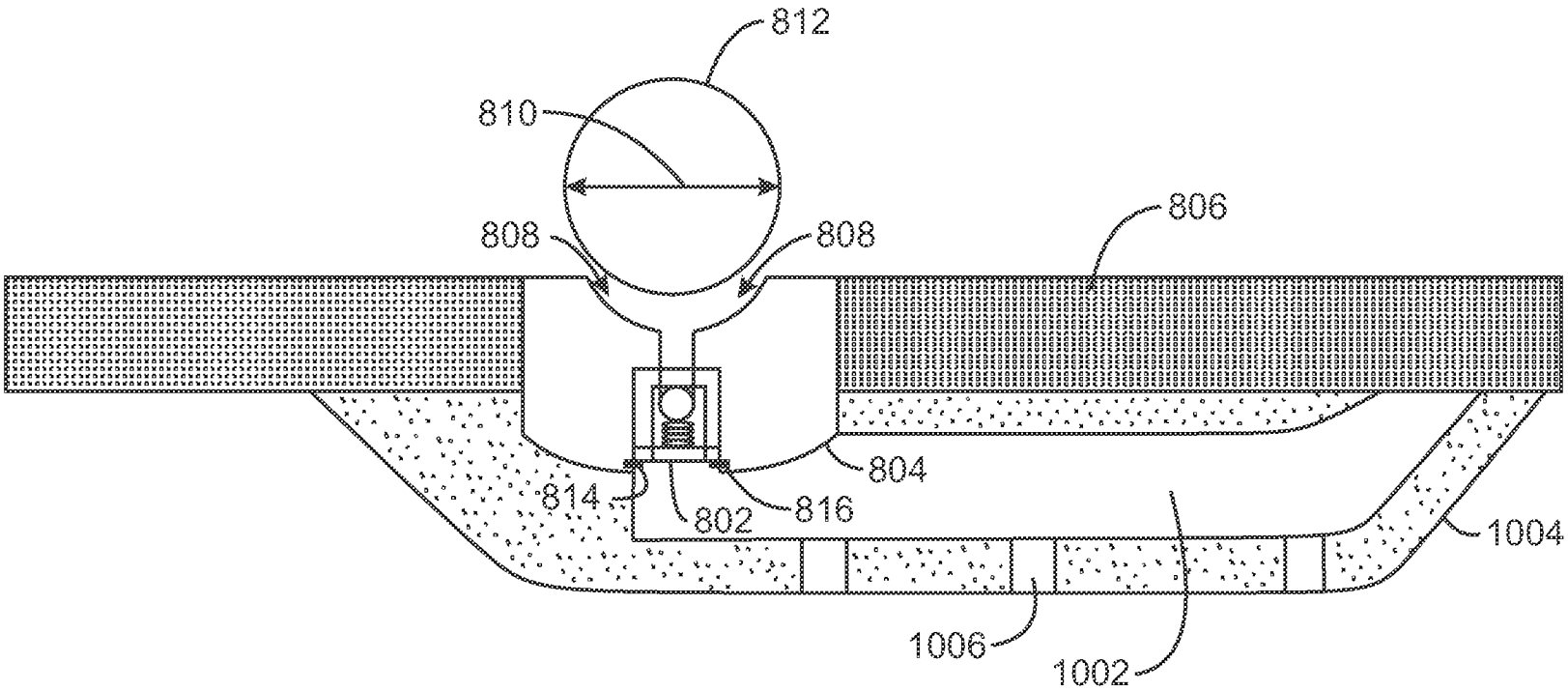
FIG. 10 is a cross sectional view of a check valve in a mounting device that is incorporated into the wall of a pipe segment, such as a production liner, casing joint, and the like, wherein the check valve opens into a distribution chamber.

FIG. 10 is a cross sectional view 800 of a check valve 802 in a mounting device 804 that is incorporated into the wall 806 of a pipe segment, such as a production liner, casing joint, and the like, wherein the check valve opens into a distribution chamber 1002. Like numbered items are as described with respect to FIG. 9. The distribution chamber 1002 is formed by a protrusion 1004 that covers the mounting device 804. For example, the distribution chamber 1002 may be formed from a metal wall 1004 that is welded to the wall 806 of the pipe segment. Openings 1006 in the metal wall 1004 allow fluids that flow from the check valve 802 to flow into the formation.

Figure 11:
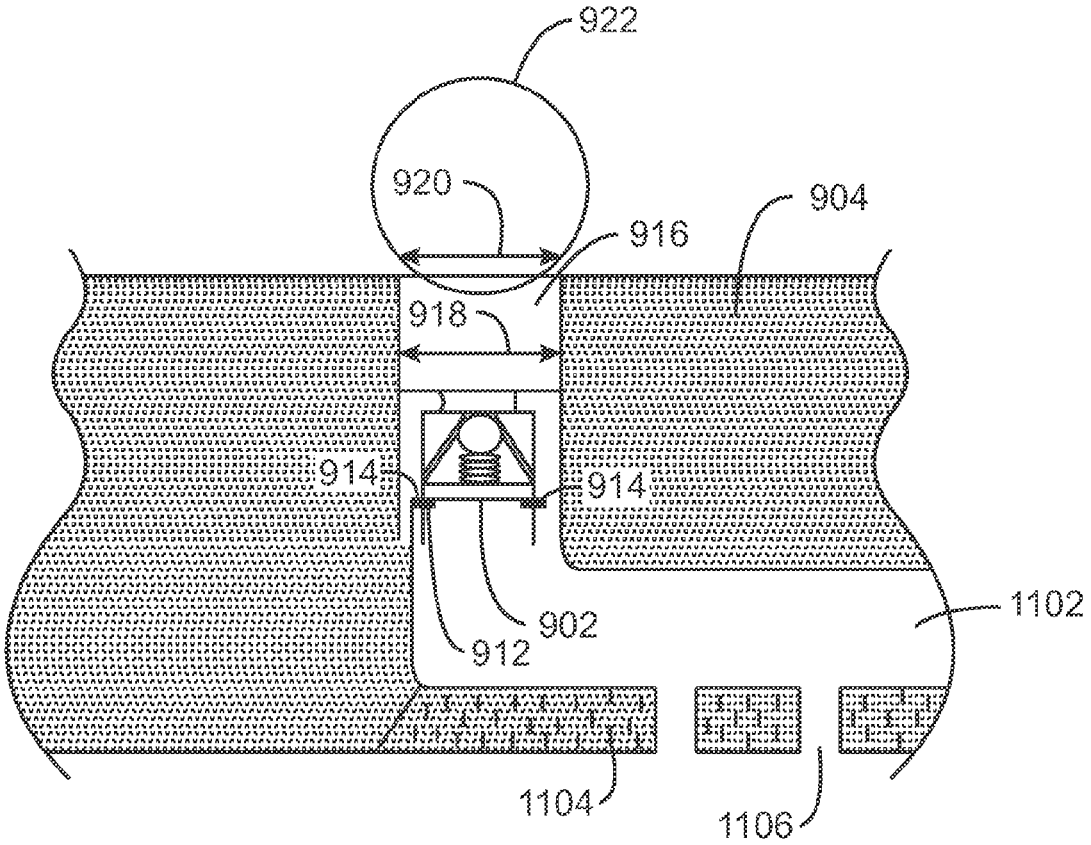
FIG. 11 is a cross sectional view of another mounting arrangement for a check valve on a wall of a pipe segment, such as a production liner, casing joint, and the like, wherein the check valve opens into a recessed chamber in the pipe wall.

FIG. 11 is a cross sectional view 900 of another mounting arrangement for a check valve 902 on a wall 904 of a pipe segment, such as a production liner, casing joint, and the like, wherein the check valve opens into a recessed chamber 1102 in the wall 904. Like numbered items are as discussed with respect to FIG. 9. The recessed chamber 1102 may be formed by machining a groove in the wall 904, installing the check valve 902, then welding a panel 1104 over the groove. The panel 1104 has openings 1106 to allow fluid from the check valve 902 to flow out and into the formation. The openings 1006 and 1106 discussed with respect to FIGS. 10 and 11 may have check valves installed to prevent fluid from flowing into the mixing chamber.

Figure 12:
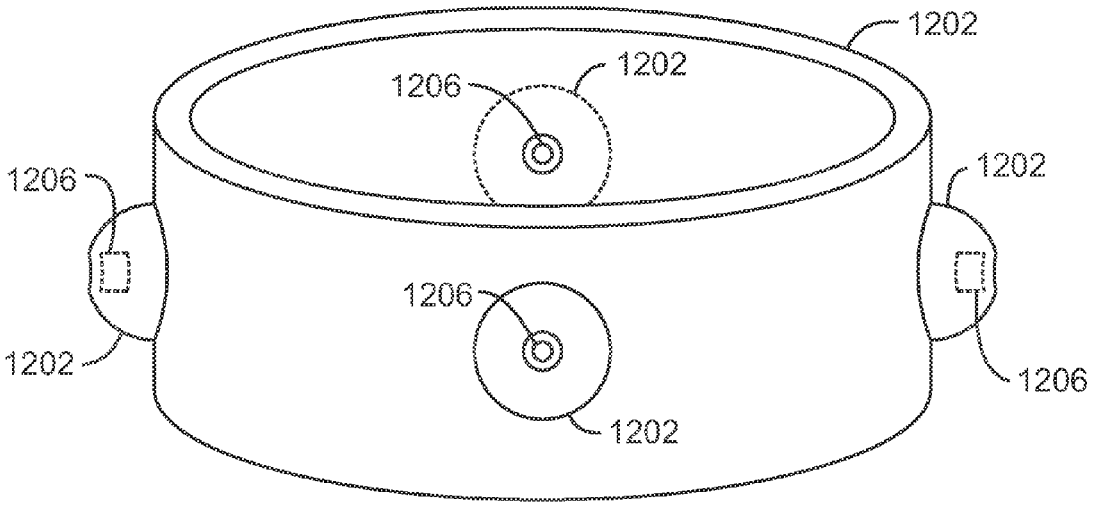
FIG. 12 is a drawing of four protrusions mounted on a casing joint.

FIG. 12 is a drawing 1200 of four protrusions 1202 mounted on a casing joint 1204. The casing joint 1204 may be a portion of a production liner, a well case, a pipe joint, or any other tubular used in a well completion. For example, the casing joint 1204 may be a coupling used to join pipe joints during the well completion. Each protrusion 1202 can hold a check valve 1206 as described herein. In addition to providing a mounting device for the check valves 1206, the protrusions 1202 can protect the check valves 1206 from damage during insertion of the casing joint 1204 into a wellbore, for example, during rotational or translational motions. The protrusions 1202 may also function as centralizers to assist in centering the production liner, or other tubular containing the casing joint 1204, in the center of the wellbore.

Method for Stimulating a Well Using Check Valves and Ball Sealers

Figure 13:
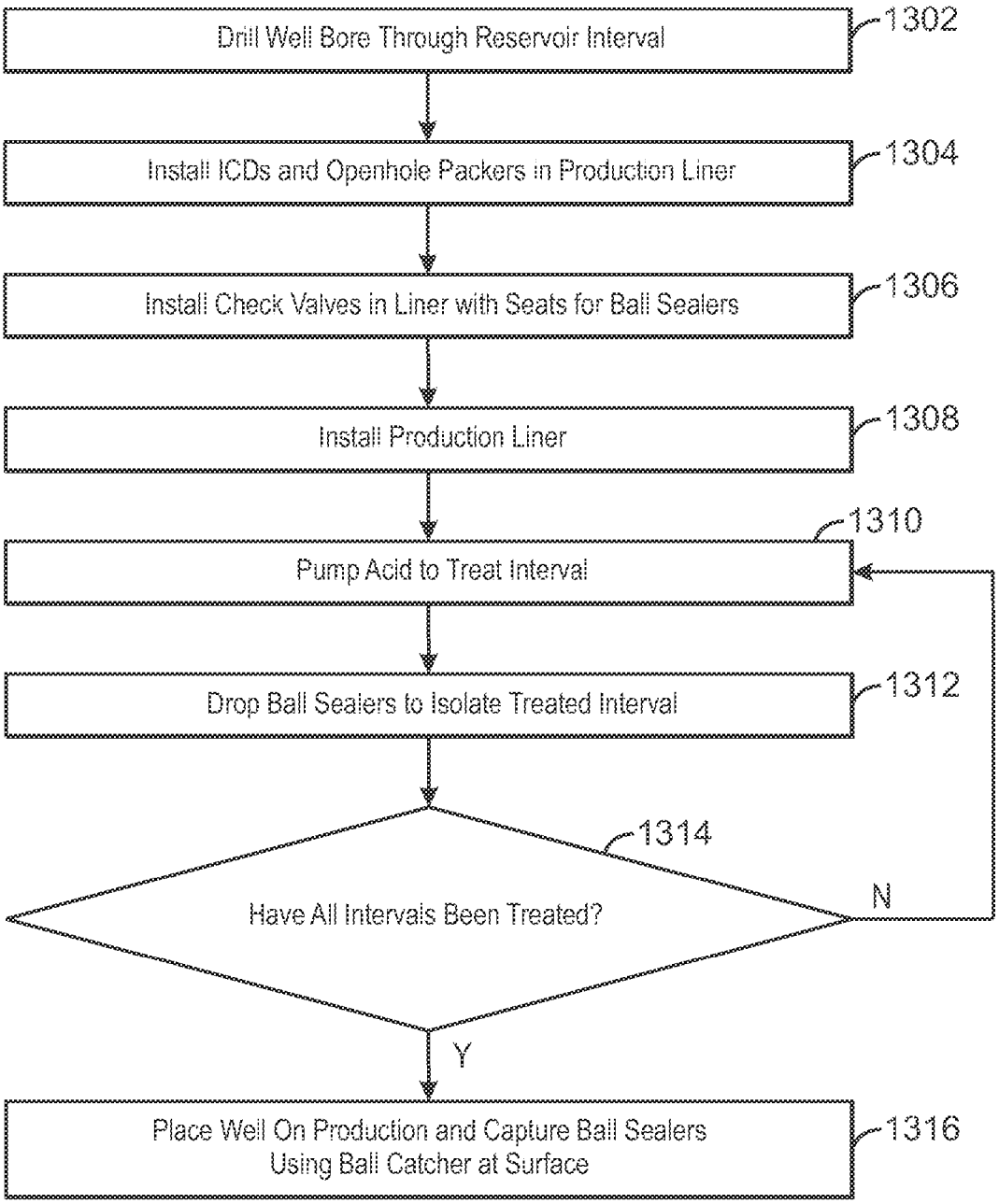
FIG. 13 is a process flow diagram of a method for stimulating a well using check valves with associated ball sealers.

FIG. 13 is a process flow diagram of a method 1300 for stimulating a well using check valves with associated ball sealers. The method 1300 begins at block 1302 with the drilling of a wellbore through a production interval. The information collected during the drilling, for example, on rock types, permeabilities, and the like can be used to determine locations for ICDs, check valves, and packers along a production liner. At block 1304, the ICDs and openhole packers are installed along the production liner, for example, by installing these devices along individual pipe joints. At block 1306, the check valves and seats for ball sealers, are installed along the production liner. This may be performed, for example, by joining individual pipe joints together with casing joints that have the check valves installed, such as described with respect to FIG. 12. The production liner can be installed into the wellbore at block 1308. After installation, the individual zones will be isolated by the packers, for example, as the packers swell in contact with production fluids.

After installation of the production liner, the stimulation procedure can be performed. At block 1310 acid, or other stimulation fluids, are pumped into the well to treat an interval. When the pressure inside of the production liner reaches a level sufficient to overcome the combined pressure of the wellbore and check valve springs in an interval, stimulation fluids are flowed into the formation. Once stimulation of the interval is completed, at block 1312, ball sealers can be dropped to isolate the treatment interval. At block 1314, a determination as to whether all intervals have been treated is made. If not, process flow returns to block 1310 to continue with the next interval.

If at block 1314, it is determined that all intervals have been treated, the well may be placed on production, which will cause the ball sealers to flow to the surface. A ball catcher at the surface can catch then be used to capture the balls. The method 1300 is not limited to a single stimulation treatment. At various points in the life of a well, it may be desirable to restimulate the well, for example, to remove precipitant, scale, and debris. The same method 1300 can be used to perform the restimulation by starting at block 1310.

Embodiments

Embodiments of the claimed subject matter may include the methods and systems disclosed in the following lettered paragraphs:

A. A method for completing a well in a reservoir, including:

injecting a stimulation fluid to stimulate a first interval in the reservoir, wherein the stimulation fluid is at a pressure sufficient to open a plurality of check valves in the first interval, allowing stimulation fluid to flow into the first interval, and wherein the stimulation fluid from at least one check valve flows into the first interval through a plurality of openings in a distribution chamber;

dropping a plurality of ball sealers into the well to stop a flow of the stimulation fluid into the first interval and begin treatment of a second interval, wherein the ball sealers are configured to block flow through the plurality of check valves in the first interval, wherein the stimulation fluid from at least one check valve flows into the second interval through a plurality of openings in a distribution chamber;

injecting the stimulation fluid to stimulate a subsequent interval in the reservoir, wherein the stimulation fluid is at a pressure sufficient to open a plurality of check valves in the subsequent interval, allowing stimulation fluid to flow into the subsequent interval, and wherein the stimulation fluid from at least one check valve flows into the subsequent interval through a plurality of openings in a distribution chamber; and repeating the dropping of ball sealers until all intervals are treated.

B. The method of paragraph A, including:

installing a plurality of check valves into a production liner, wherein the check valves are configured to allow flow from the production liner into the wellbore;

installing the production liner into a wellbore; and fluidically isolating a plurality of intervals in the wellbore, wherein at least two of the plurality of intervals are accessible from the production liner through the check valves.

C. The method of paragraph B, including installing a plurality of inflow control devices (ICDs) into the production liner.

D. The method of paragraph C, including harvesting hydrocarbons from the production liner as the hydrocarbons flow through the ICDs into the production liner.

E. The method of paragraph A, including:

placing the well into production; and capturing the ball sealers as they are flowed to the surface.

F. The method of paragraph B, including installing the check valves in casing joints installed between pipe joints of the production liner.

G. The method of paragraph A, including selecting an opening pressure for each of the plurality of check valves based on a reservoir pressure and/or permeability in each of a plurality of intervals.

H. The method of paragraph A, including fluidically isolating intervals by installing packers between each interval.

I. The method of paragraph H, wherein the packers can be swelled by exposure to hydrocarbons or water.

J. A system for stimulation of a well, including:

a wellbore drilled through an interval in a reservoir;

a production liner installed in the wellbore, wherein the production liner includes a plurality of check valves configured to allow flow from the production liner into the wellbore, and wherein at least a portion of the plurality of check valves are configured to allow flow into a distribution chamber and then into the wellbore;

a seat in the production liner behind each check valve, wherein the seat is configured to block the flow of fluid through the check valve when a ball sealer is in place on the seat;

a plurality of packers placed in the well in the annulus between the wellbore and the production liner, wherein an interval is defined by the location of two sequential packers, and wherein at least two intervals are accessible from the wellbore through check valves; and an injection system configured to inject a plurality of ball sealers into the production liner as a pressure of a stimulation fluid in the production liner is increased.

K. The system of paragraph J, including a ball catcher configured to intercept the ball sealers once the well is placed into production.

L. The system of paragraph J, wherein the plurality of check valves are configured to withstand liner rotation.

M. The system of paragraph J, wherein the exit of a check valve includes a high-velocity jet.

N. The system of paragraph J, wherein the profile of the seat matches a diameter of a ball sealer.

O. The system of paragraph J, wherein a check valve is installed in a protrusion from a side of a piping segment.

Still other embodiments of the claimed subject matter may include the methods and systems disclosed in the following numbered paragraphs:

1. A method for completing a well in a reservoir, including:

injecting a stimulation fluid to stimulate a first interval in the reservoir, wherein the stimulation fluid is at a pressure sufficient to open a plurality of check valves in the first interval, allowing stimulation fluid to flow into the first interval, and wherein the stimulation fluid from at least one check valve flows into the first interval through a plurality of openings in a distribution chamber;

dropping a plurality of ball sealers into the well to stop a flow of the stimulation fluid into the first interval and begin treatment of a second interval, wherein the ball sealers are configured to block flow through the plurality of check valves in the first interval, wherein the stimulation fluid from at least one check valve flows into the second interval through a plurality of openings in a distribution chamber;

injecting the stimulation fluid to stimulate a subsequent interval in the reservoir, wherein the stimulation fluid is at a pressure sufficient to open a plurality of check valves in the subsequent interval, allowing stimulation fluid to flow into the subsequent interval, and wherein the stimulation fluid from at least one check valve flows into the subsequent interval through a plurality of openings in a distribution chamber; and repeating the dropping of ball sealers until all intervals are treated.

2. The method of paragraph 1, including:

installing a plurality of check valves into a production liner, wherein the check valves are configured to allow flow from the production liner into the wellbore;

installing the production liner into a wellbore; and fluidically isolating a plurality of intervals in the wellbore, wherein at least two of the plurality of intervals are accessible from the production liner through the check valves.

3. The method of paragraph 2, including installing a plurality of inflow control devices (ICDs) into the production liner.

4. The method of paragraph 3, including harvesting hydrocarbons from the production liner as the hydrocarbons flow through the ICDs into the production liner.

5. The method of paragraph 1, including:

placing the well into production; and capturing the ball sealers as they are flowed to the surface.

6. The method of paragraph 2, including installing the check valves by tapping holes in the liner.

7. The method of paragraph 2, including installing the check valves in casing joints installed between pipe joints of the production liner.

8. The method of paragraph 1, including selecting an opening pressure for each of the plurality of check valves based on a reservoir pressure and/or permeability in each of a plurality of intervals.

9. The method of paragraph 1, including fluidically isolating intervals by installing packers between each interval.

10. The method of paragraph 9, wherein the packers can be swelled by exposure to hydrocarbons or water.

11. A system for stimulation of a well, comprising:

a wellbore drilled through an interval in a reservoir;

a production liner installed in the wellbore, wherein the production liner comprises a plurality of check valves configured to allow flow from the production liner into the wellbore, and wherein at least a portion of the plurality of check valves are configured to allow flow into a distribution chamber and then into the wellbore;

a seat in the production liner behind each check valve, wherein the seat is configured to block the flow of fluid through the check valve when a ball sealer is in place on the seat;

a plurality of packers placed in the well in the annulus between the wellbore and the production liner, wherein an interval is defined by the location of two sequential packers, and wherein at least two intervals are accessible from the wellbore through check valves; and an injection system configured to inject a plurality of ball sealers into the production liner as a pressure of a stimulation fluid in the production liner is increased.

12. The system of paragraph 11, including a ball catcher configured to intercept the ball sealers once the well is placed into production.

13. The system of paragraph 11, wherein the plurality of check valves are configured to withstand liner rotation.

14. The system of paragraph 11, wherein the exit of a check valve includes a high-velocity jet.

15. The system of paragraph 11, wherein the profile of the seat matches a diameter of a ball sealer.

16. The system of paragraph 11, wherein a check valve is installed in a protrusion from a side of a piping segment.

17. The system of paragraph 11, including a plurality of inflow control devices (ICDs) configured to allow a controlled flow of fluids from the well bore into the production liner.

18. The system of paragraph 17, wherein the ICDs are designed to prevent unwanted fluids from entering the production liner.

19. The system of paragraph 11, wherein at least a portion of the plurality of packers includes oil swellable materials, water swellable materials, or both.

20. A method for harvesting hydrocarbons from a well in a production interval, comprising:

installing a production liner into a wellbore in a reservoir, wherein the production liner comprises:

a plurality of check valves that are configured to allow flow from the production liner into the wellbore, wherein at least a portion of the plurality of check valves are configured to allow flow into a distribution chamber with multiple openings into the wellbore; and inflow control devices configured to allow a controlled fluid flow from the wellbore into the production liner;

fluidically isolating a plurality of intervals along the wellbore by installing packers in the annulus between the wellbore and the production liner to isolate each interval from an adjacent interval, wherein at least two intervals are accessible from the production liner by check valves;

injecting a stimulation fluid to stimulate a first interval in the reservoir;

dropping a set of ball sealers into the reservoir to stop acid flow into the first interval and begin treatment of a second interval;

repeating the dropping of ball sealers until all intervals are treated;

placing the well into production to harvest the hydrocarbons; and catching the ball sealers in a ball catcher as they flow to the surface.

21. The method of paragraph 20, including taking the well out of production;

injecting a fluid including ball sealers at a selected pressure to isolate an interval;

injecting a stimulation fluid to stimulate a target interval;

placing the well back into production; and catching the ball sealers in a ball catcher as they flow to the surface.

What is claimed is:

1. A method for completing a well in a reservoir, comprising:

injecting a stimulation fluid to stimulate a first interval in the reservoir, wherein the stimulation fluid is at a pressure sufficient to open a plurality of check valves in the first interval, allowing stimulation fluid to flow into the first interval, and wherein the stimulation fluid from at least one check valve flows into the first interval through a plurality of openings in a distribution chamber;

dropping a plurality of ball sealers into the well to stop a flow of the stimulation fluid into the first interval and begin treatment of a second interval, wherein the ball sealers are configured to block flow through the plurality of check valves in the first interval, wherein the stimulation fluid from at least one check valve flows into the second interval through a plurality of openings in a distribution chamber;

injecting the stimulation fluid to stimulate a subsequent interval in the reservoir, wherein the stimulation fluid is at a pressure sufficient to open a plurality of check valves in the subsequent interval, allowing stimulation fluid to flow into the subsequent interval, and wherein the stimulation fluid from at least one check valve flows into the subsequent interval through a plurality of openings in a distribution chamber; and repeating the dropping of ball sealers until all intervals are treated.

2. The method of claim 1, comprising:

installing a plurality of check valves into a production liner, wherein the check valves are configured to allow flow from the production liner into the wellbore;

installing the production liner into a wellbore; and fluidically isolating a plurality of intervals in the wellbore, wherein at least two of the plurality of intervals are accessible from the production liner through the check valves.

3. The method of claim 2, comprising installing a plurality of inflow control devices (ICDs) into the production liner.

4. The method of claim 3, comprising harvesting hydrocarbons from the production liner as the hydrocarbons flow through the ICDs into the production liner.

5. The method of claim 2, comprising installing the check valves by tapping holes in the liner.

6. The method of claim 2, comprising installing the check valves in casing joints installed between pipe joints of the production liner.

7. The method of claim 1, comprising:

placing the well into production; and capturing the ball sealers as they are flowed to the surface.

8. The method of claim 1, comprising selecting an opening pressure for each of the plurality of check valves based on a reservoir pressure and/or permeability in each of a plurality of intervals.

9. The method of claim 1, comprising fluidically isolating intervals by installing packers between each interval.

10. The method of claim 9, wherein the packers can be swelled by exposure to hydrocarbons or water.

11. A system for stimulation of a well, comprising:

a wellbore drilled through an interval in a reservoir;

a production liner installed in the wellbore, wherein the production liner comprises a plurality of check valves configured to allow flow from the production liner into the wellbore, and wherein at least a portion of the plurality of check valves are configured to allow flow into a distribution chamber and then into the wellbore;

a seat in the production liner behind each check valve, wherein the seat is configured to block the flow of fluid through the check valve when a ball sealer is in place on the seat;

a plurality of packers placed in the well in the annulus between the wellbore and the production liner, wherein an interval is defined by the location of two sequential packers, and wherein at least two intervals are accessible from the wellbore through check valves; and an injection system configured to inject a plurality of ball sealers into the production liner as a pressure of a stimulation fluid in the production liner is increased.

12. The system of claim 11, comprising a ball catcher configured to intercept the ball sealers once the well is placed into production.

13. The system of claim 11, wherein the plurality of check valves are configured to withstand liner rotation.

14. The system of claim 11, wherein the exit of a check valve comprises a high-velocity jet.

15. The system of claim 11, wherein the profile of the seat matches a diameter of a ball sealer.

16. The system of claim 11, wherein a check valve is installed in a protrusion from a side of a piping segment.

17. The system of claim 11, comprising a plurality of inflow control devices (ICDs) configured to allow a controlled flow of fluids from the well bore into the production liner.

18. The system of claim 17, wherein the ICDs are designed to prevent unwanted fluids from entering the production liner.

19. The system of claim 11, wherein at least a portion of the plurality of packers comprises oil swellable materials, water swellable materials, or both.

20. A method for harvesting hydrocarbons from a well in a production interval, comprising:

installing a production liner into a wellbore in a reservoir, wherein the production liner comprises:

a plurality of check valves that are configured to allow flow from the production liner into the wellbore, wherein at least a portion of the plurality of check valves are configured to allow flow into a distribution chamber with multiple openings into the wellbore; and inflow control devices configured to allow a controlled fluid flow from the wellbore into the production liner;

fluidically isolating a plurality of intervals along the wellbore by installing packers in the annulus between the wellbore and the production liner to isolate each interval from an adjacent interval, wherein at least two intervals are accessible from the production liner by check valves;

injecting a stimulation fluid to stimulate a first interval in the reservoir;

dropping a set of ball sealers into the reservoir to stop acid flow into the first interval and begin treatment of a second interval;

repeating the dropping of ball sealers until all intervals are treated;

placing the well into production to harvest the hydrocarbons; and catching the ball sealers in a ball catcher as they flow to the surface.

21. The method of claim 20, comprising;

taking the well out of production;

injecting a fluid comprising ball sealers at a selected pressure to isolate an interval;

injecting a stimulation fluid to stimulate a target interval;

placing the well back into production; and catching the ball sealers in a ball catcher as they flow to the surface.

* * * * *